US009441384B2

(12) United States Patent
Rosati et al.

(10) Patent No.: US 9,441,384 B2
(45) Date of Patent: Sep. 13, 2016

(54) REMOVABLE BARRIER FOR LOCATION ON AN UPPER PORTION OF A WALL

(75) Inventors: Emilio Rosati, Rossmore (AU); Paul Brazis, Altona North (AU)

(73) Assignee: Form 700 Pty Ltd, Victoria (AU)

( * ) Notice: Subject to any disclaimer, the term of this patent is extended or adjusted under 35 U.S.C. 154(b) by 346 days.

(21) Appl. No.: 13/580,345

(22) PCT Filed: Feb. 24, 2011

(86) PCT No.: PCT/AU2011/000202

§ 371 (c)(1),
(2), (4) Date: Oct. 25, 2012

(87) PCT Pub. No.: WO2011/103631

PCT Pub. Date: Sep. 1, 2011

(65) Prior Publication Data

US 2013/0037770 A1 Feb. 14, 2013

(30) Foreign Application Priority Data

Feb. 24, 2010 (AU) ..... 2010900784

(51) Int. Cl.

| | |
|---|---|
| ***E04H 17/16*** | (2006.01) |
| ***E04G 21/32*** | (2006.01) |
| *E04G 5/14* | (2006.01) |

(52) U.S. Cl.

CPC ..... *E04G 21/3223* (2013.01); *E04G 21/3214* (2013.01); *E04G 21/3219* (2013.01); *E04H 17/163* (2013.01); *E04G 2005/148* (2013.01)

(58) Field of Classification Search

CPC ..... E04G 21/3223; E04G 21/3228; E04G 21/3233; E04G 5/142; E04G 5/144; E04G 2005/148; E04G 21/3219; E04G 21/3214; E04G 21/3261; E04H 17/163; Y10S 256/06

USPC ..... 256/12.5, 26, 65.15, 67, DIG. 6; 182/113, 82; 49/55

See application file for complete search history.

(56) References Cited

U.S. PATENT DOCUMENTS 3,770,245 A * 11/1973 Murdock ..... 256/24
3,839,834 A * 10/1974 Goddard ..... 52/238.1

(Continued)

FOREIGN PATENT DOCUMENTS

DE 1212707 * 11/1960
DE 4415827 A1 11/1995

(Continued)

OTHER PUBLICATIONS

International Search Report for International Application No. PCT/AU2011/000202, dated May 4, 2011, 3 pages.

(Continued)

*Primary Examiner* — Dan Wiley
*Assistant Examiner* — Matthew R McMahon
(74) *Attorney, Agent, or Firm* — Nixon Peabody LLP

(57) ABSTRACT

Aspects of this invention relate to a barrier for fixing to an portion of a wall. The barrier includes at least one plate that is securable to the wall. For each plate, there is a vertical upright attached to and extending upwardly from the plate to which the barrier is secured. The barrier is held by the vertical upright above the upper portion of the wall as required. removable from the vertical upright to allow access to the upper portion of the wall as required. In one aspect, at least a portion of the barrier is moveable relative to a remainder of the barrier and between a first portion, where it is located above an upper edge of the wall, and a second portion, where access is then provided to the upper wall edge above which the movable barrier portion was positioned.

17 Claims, 2 Drawing Sheets

(56) References Cited

U.S. PATENT DOCUMENTS

| | | | | | |
|---|---|---|---|---|---|
| 3,863,899 | A | * | 2/1975 | Werner | 256/24 |
| 3,901,481 | A | | 8/1975 | Probst | |
| 4,129,197 | A | * | 12/1978 | Preston | 182/82 |
| 4,138,094 | A | * | 2/1979 | Thir | 256/67 |
| 4,236,698 | A | * | 12/1980 | Compte | 256/23 |
| 4,787,475 | A | * | 11/1988 | Arteau et al. | 182/82 |
| 5,221,076 | A | * | 6/1993 | Zust | 256/31 |
| 5,570,543 | A | * | 11/1996 | Bishop | 49/465 |
| 5,771,505 | A | * | 6/1998 | Reynolds | 4/559 |
| 6,138,993 | A | * | 10/2000 | Mitchell et al. | 256/25 |
| 6,151,852 | A | * | 11/2000 | Linn et al. | 52/239 |
| 6,540,209 | B2 | * | 4/2003 | Ross | 256/68 |
| 6,679,482 | B2 | * | 1/2004 | Allenbaugh | 256/65.14 |
| 6,857,504 | B1 | * | 2/2005 | Branter | 182/113 |
| 6,908,075 | B1 | * | 6/2005 | Nichols | 256/59 |
| 7,810,285 | B1 | * | 10/2010 | Liptak | 52/69 |
| 8,083,028 | B2 | * | 12/2011 | Johnson | 182/113 |
| 8,387,955 | B2 | * | 3/2013 | Ptacek et al. | 256/31 |
| 2006/0278472 | A1 | | 12/2006 | Kenton et al. | |
| 2008/0028694 | A1 | * | 2/2008 | Wasitis et al. | 52/127.4 |
| 2009/0145075 | A1 | | 6/2009 | Oakley | |

FOREIGN PATENT DOCUMENTS

| | | | |
|---|---|---|---|
| EP | 2096236 | * | 9/2009 |
| EP | 2378032 A1 | * | 10/2011 |
| GB | 2347710 A | | 9/2000 |

OTHER PUBLICATIONS

Written Opinion for International Application No. PCT/AU2011/000202, dated May 4, 2011, 2 pages.

* cited by examiner

REMOVABLE BARRIER FOR LOCATION ON AN UPPER PORTION OF A WALL

CROSS-REFERENCE TO RELATED APPLICATIONS

This application is a U.S. National Stage of International Application No. PCT/AU2011/000202, filed Feb. 24, 2011, which claims the benefit of Australian Patent Application No. 2010900784, filed Feb. 24, 2010, each of which is hereby incorporated by reference herein in its entirety.

FIELD OF THE INVENTION

This invention relates to a moveable barrier and in particular to a barrier for location on the upper portion of a wall.

BACKGROUND OF THE INVENTION

There is a need to provide a barrier which acts both as a safety barrier and a hand rail for construction workers working on first or subsequent storeys of a building under construction, particularly when there is a need to be working adjacent to the upper edge of a wall at the uppermost level at that stage of the building's construction. Obviously, there is a need to prevent accidental falls from these elevated positions.

Such situations commonly occur when constructing buildings using precast concrete slabs to form perimeter walls. This construction uses precast concrete wall sections that are cast either off-site or on-site. Using precast concrete walls, particularly for multi storey buildings requires the construction of reinforced concrete floors towards the upper edge of the walls. This is achieved using conventional casting techniques to produce columns and floors using reinforced or post-stressed concrete construction techniques.

During the process of installing the necessary form work to produce these columns and floors, it is necessary for workers to be in an elevated position which is near the edge of the floors adjacent the previously positioned precast walls.

In order to provide a barrier on the upper edge of these walls, barriers comprising a plurality of vertical uprights and horizontal bars have been used. The use of spaced horizontal bars allows workers to reach through the bars to conduct work on the upper edge of the wall at the time of locating and fixing the next precast wall section on the top edge of a previously positioned wall section. This work includes the location of height adjusting packers, sealant strips on the inside and outside edges of the wall and adding grout which is used to help secure the upper wall panel to the lower wall panel.

Clearly, access to the upper edge of the lower (ie. previously positioned) wall panel is required in order to carry out this work.

However, there is a need for these upper barriers to not only prevent falls by workers, but also to prevent loose objects from falling from a height. Accordingly, it is a requirement in some instances for the barriers to have a relatively fine mesh installed from the top to the bottom of the barrier. Obviously, such a requirement then makes it extremely difficult to conduct the required work involved in positioning and attaching the next precast wall segment.

Accordingly, it is an object of the invention to overcome one or more of the above mentioned problems, or at least, provide a useful alternative to known barrier systems.

Other objects and advantages of the present invention will become apparent from the following description, taken in connection with the accompanying drawings, wherein, by way of illustration and example, an embodiment of the present invention is disclosed.

SUMMARY OF THE INVENTION

In one aspect, the invention is a barrier for fixing to an upper portion of a wall, the barrier comprising:

fixing means securable to the wall, and a barrier held by the fixing means that locates above the upper portion of the wall, wherein the barrier is removable from the fixing means to allow access to the upper portion of the wall as required.

In one form, a plurality of fixing means may be secured to the wall, where the number of fixing means used depends on the length of the barrier.

In one form, the fixing means comprises a plate which can be fastened to the walls using conventional fastening means, such as masonry bolts.

In one form, vertical uprights are attached to the fixing means to which the barrier may then be secured.

In one form, in addition to being removable, the barrier may be moveable between a first position where it is located above the wall, to a second position where access is then provided to a required position of the upper edge of the wall. For example, the barrier or a portion of the barrier may be hinged with respect to the fixing means, or a portion of the barrier may be slidable with respect to another portion of the barrier. In one form, two or more hinged or slidable portions may be provided in any single length of barrier utilized on the edge of the wall.

In one form, the or each movable barrier portion is telescopically extendible and retractable with respect to a remainder of the barrier.

In one form, a number of individual barriers of predetermined length are provided to allow access to the ends of each wall segment which are the main areas requiring access. However, a single barrier extending along the full length of one edge of a wall may also be used provided there are removable or moveable portions at required locations.

In one form, the or each movable barrier portion is releasably securable in at least its extended position.

In one form, the or each movable barrier portion is releasably securable in any one of an array of positions between and including its fully retracted and fully extended positions.

In one form, the barrier includes an attachment point for a hoist line, via which hoist line and attachment point the barrier can be lifted and moved.

In a further aspect, the invention may be said to reside in a barrier for fixing to an upper portion of a wall, the barrier comprising fixing means securable to the wall and a first barrier portion held by the fixing means that locates above the upper portion of the wall, wherein at least a second portion of the barrier is moveable relative to the first portion of the barrier and between a first position where it is located above an upper portion of the wall, and a second position where access is then provided to the upper wall portion above which the movable barrier portion was previously positioned.

In yet a further aspect, the invention may be said to reside in a barrier of extensible length for fixing to an upper portion of a wall, the barrier comprising:

fixing means securable to the wall, and a barrier held by the fixing means that locates above the upper portion of the wall, wherein the barrier is removable from the fixing means to allow access to the upper portion of the wall as required.

In one form, the barrier comprises first and second ends, and portions extensible from each end.

In yet a further aspect, a barrier is presented for fixing with respect to an upper portion of a wall for a building. The barrier includes a first barrier panel comprising a perimeter frame and an infill panel, the perimeter frame comprising a top frame member, a bottom frame member and opposing side frame members. The barrier also includes a fixing structure configured to secure the first barrier panel with respect to the wall, the fixing structure comprising a pair of wall attachment members securable with respect to the wall, an upright attached to and extending upwardly from each wall attachment member and an upper panel attachment member and a lower panel attachment member attached to the upright. The first barrier panel is held by the upper and lower panel attachment members of the fixing structure so as to locate the first barrier panel above and along a first upper portion of the wall. The first barrier panel is removable from the fixing structure to allow access to the first upper portion of the wall as required. The barrier includes at least a second or third barrier panel comprising an infill panel. This second or third barrier panel depends from the first barrier panel and is extendible and retractable with respect to the first barrier panel between at least a first position, where it is located above and along a further upper portion of the wall, and a second position, where access is then provided to the further upper wall portion above and along which the second or third barrier panel was previously positioned.

In order to fully understand the invention, the preferred embodiment will now be described. However it should be realised that the invention is not be confined or restricted to the precise features of this invention and that variations or changes that would be readily apparent to a skilled addressee are deemed to be incorporated within the scope of the invention.

The embodiment is illustrated in the accompanying drawing which shows various views of a barrier.

BRIEF DESCRIPTION OF THE DRAWINGS

For a better understanding of this disclosure it will now be described with respect to one or more exemplary embodiments, which shall be described herein with the assistance of drawings wherein.

In the following description, like reference characters designate like or corresponding parts throughout the several views of the drawings.

DESCRIPTION OF A PREFERRED EMBODIMENT

Figures 1, 2:
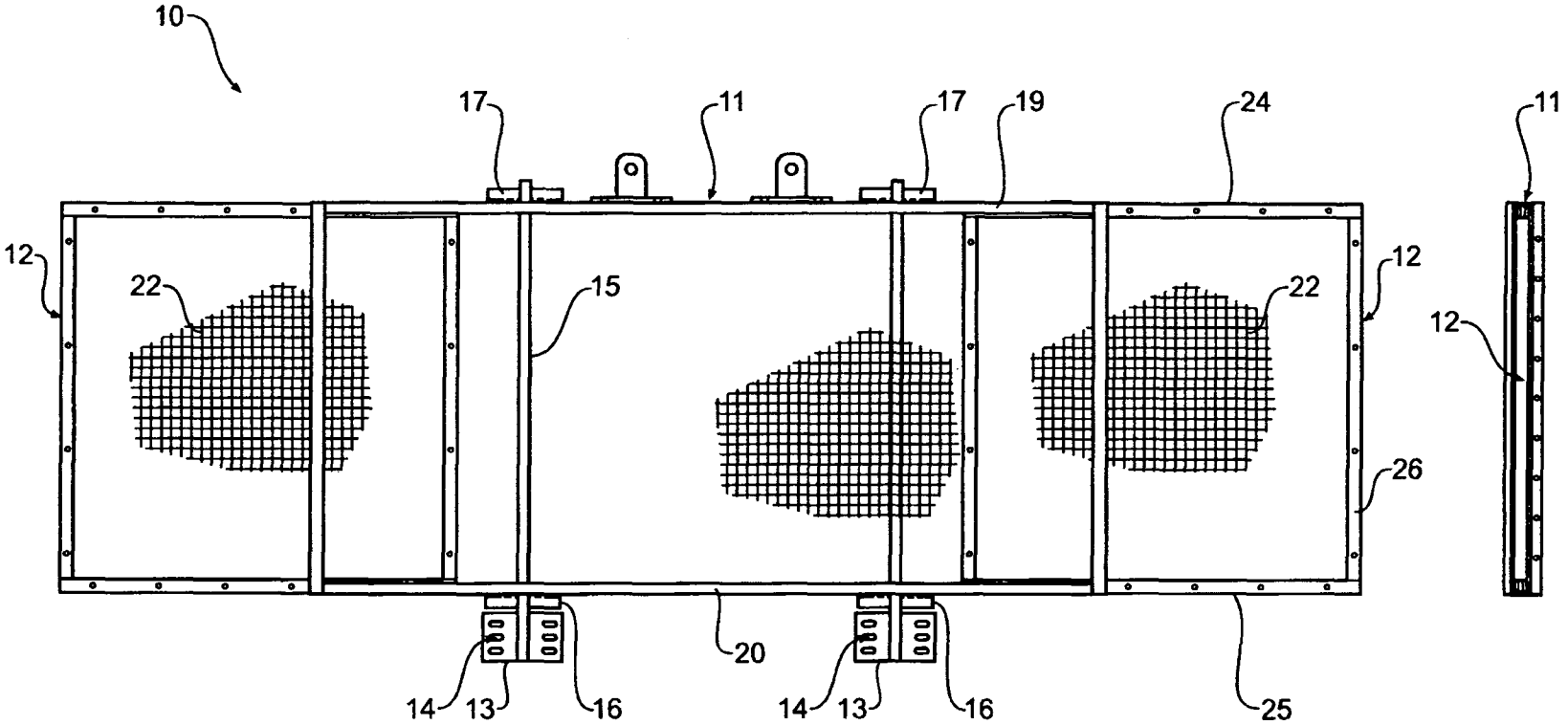
FIG. 1 is a plan view of a barrier.
FIG. 2 is an end view of the barrier illustrated in FIG. 1.
Figure 3:
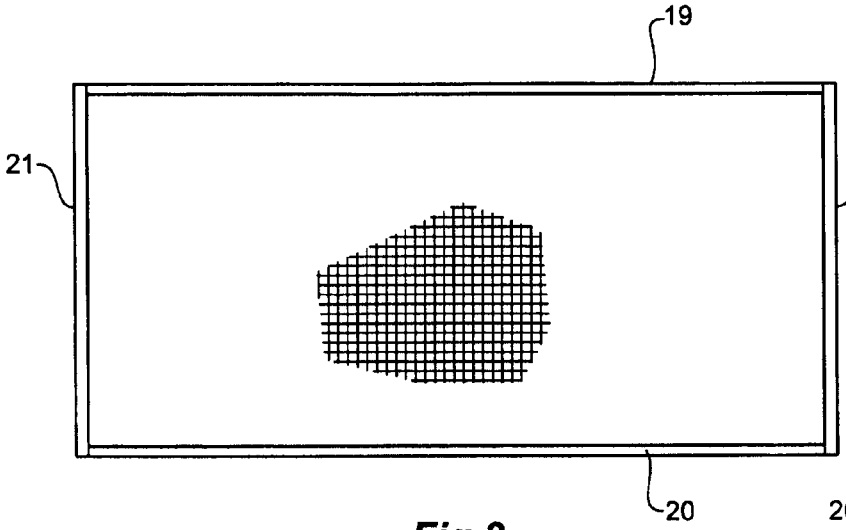
FIG. 3 is a plan view of a centre panel of the barrier illustrated in FIGS. 1 and 2.
Figure 4:
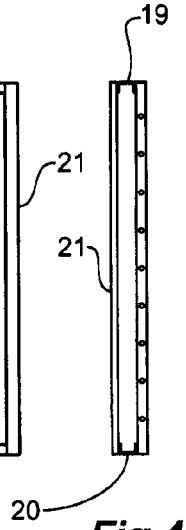
FIG. 4 is an end view of the centre panel illustrated in FIG. 3.
Figure 5:
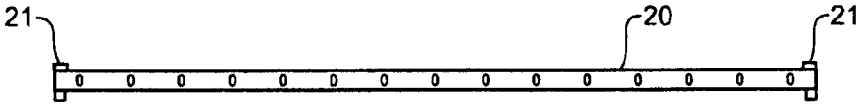
FIG. 5 is a top view of the centre panel illustrated in FIGS. 3 and 4.
Figure 6:
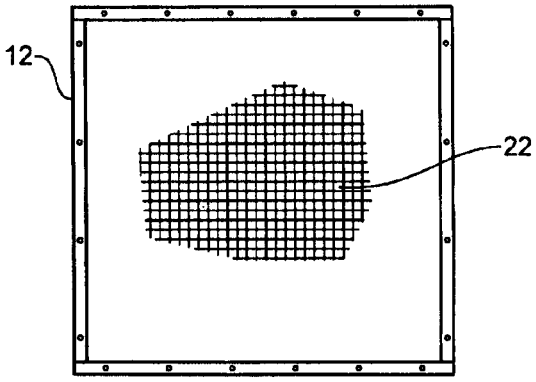
FIG. 6 is a plan view of a side panel of the barrier illustrated in FIGS. 1 and 2.

In the figures, there is illustrated a barrier 10 that comprises a centre panel 11 (also referred to herein as "first barrier panel") and two side panels 12 (also referred to herein as "side barrier panels" or "second and third barrier panels").

The barrier 10 further comprises fixing means. The fixing means comprises a pair of plates 13 having apertures 14 that allow threaded fasteners to secure the plates 13 to the upper edge of a precast wall (wall not shown).

An upright 15 is attached to and extends upwardly from each plate 13, and the centre panel 11 is then secured to upper and lower brackets 17 and 16 which are attached to the upright 15 near upper and lower ends thereof respectively.

The centre panel 11 comprises an outer perimeter frame of rectangular shape, and an infill panel of mesh 22 fixed within the perimeter frame.

The outer perimeter frame of the centre panel 11 comprises top and bottom frame members 19 and 20, and side frame members 21. The infill of mesh 22 is fixed within the perimeter frame between the top, bottom and side frame members 19, 20, and 21.

Threaded fasteners locate through respective apertures in both the upper and lower brackets 16 and 17, and the top and bottom frame members 19 and 20, to thereby secure the centre panel 11 to the uprights 15, plates 13, and the upper edge of the precast wall in turn.

Similar to the centre panel 11, each of the side panels 12 comprises an outer perimeter frame of rectangular shape, and an infill panel of mesh 22 fixed within the perimeter frame.

The outer perimeter frame of the side panels 12 comprises top and bottom frame members 24 and 25, and side frame members 26. The infill of mesh 22 is fixed within the perimeter frame between the top, bottom and side frame members 24, 25 and 26.

The provision of the mesh 22 infill panel within each of the centre and side panels 11 and 12 ensures improved security by comparison to previous barriers to ensure that loose objects (such as tools for instance) do not accidently fall from an elevated position, as well as providing security for workers against falling.

The outer perimeter frame of the centre panel 11 comprises a length of right angle cross-section forming or fixed to each of the top and bottom frame members 19 and 20 to form upper and lower U-Shaped channels within which the top and bottom edges respectively of the two side panels 12 locate, so that each side panel 12 can slide between a fully retracted and fully extended position with respect to and from an end of the centre panel 11. This enables each of the side panels 12 to be slid with a telescoping action to a retracted position where the side panel 12 is fully retracted so that it lays entirely within or over the centre panel 11.

Accordingly, the barrier 10 with side panels 12 in their extended position provides a continuous barrier along the edge of a wall over their entire length. A number of the barriers 10 comprising centre and side panels 11 and 12 can be positioned along the upper length of a wall with the side panels 12 being positioned to provide access as required to the upper edge portions of the wall panels to enable preparation for positioning and fixing of the next wall panel on the upper edge of the wall panel to which the barrier 10 is secured.

Throughout the specification and the claims that follow, unless the context requires otherwise, the words "comprise" and "include" and variations such as "comprising" and "including" will be understood to imply the inclusion of a stated integer or group of integers, but not the exclusion of any other integer or group of integers.

The reference to any prior art in this specification is not, and should not be taken as, an acknowledgement of any form of suggestion that such prior art forms part of the common general knowledge.

It will be appreciated by those skilled in the art that the invention is not restricted in its use to the particular application described. Neither is the present invention restricted in its preferred embodiment with regard to the particular elements and/or features described or depicted herein. It will be appreciated that various modifications can be made without departing from the principles of the invention. Therefore, the invention should be understood to include all such modifications in its scope.

The invention claimed is:

1. A barrier of extendible length for fixing with respect to an upper portion of a wall of a building, the barrier comprising:

a first barrier panel comprising a first perimeter frame and a first infill panel, the first perimeter frame comprising a top frame member, a bottom frame member and opposing side frame members;

a fixing structure configured to secure the first barrier panel with respect to the upper portion of the wall, the fixing structure comprising:

a pair of wall attachment members securable with respect to the wall;

an upright attached to and extending upwardly from each wall attachment member; and an upper bracket and a lower bracket attached to the upright;

the upper frame member of the first barrier panel being held by the upper bracket of the fixing structure and the lower frame member of the first barrier panel being held by the lower bracket of the fixing structure so as to locate the first barrier panel above and along a first upper portion of the wall, wherein the first barrier panel is removable from the fixing structure to allow access to the first upper portion of the wall as required; and a second barrier panel comprising a second perimeter frame and a second infill panel, the second perimeter frame comprising a top frame member, a bottom frame member, and opposing side frame members wherein the first barrier panel further comprises upper and lower U-shaped channels within which a top edge and a bottom edge, respectively, of the second barrier panel locate, wherein the opposing side frame members of the first barrier panel define first and second ends and wherein the second barrier panel is telescopically extendible and retractable from the first end, and wherein in use, the fixing structure is configured to be secured with respect to the wall, the first barrier panel is configured to be secured with respect to the fixing structure, and the second barrier panel depends from the first barrier panel and is extendible and retractable with respect to the first end of the first barrier panel between at least a first position, whereat the second barrier panel is located above and along an upper portion of the wall, and a second position, whereat access is then provided to the upper wall portion above and along which the second barrier panel was previously positioned.

2. The barrier of claim 1, further comprising a third barrier panel moveable relative to the second end of the first barrier panel and between respective first and second positions.

3. The barrier of claim 2, wherein the third barrier panel is telescopically extendible and retractable with respect to the second end of the first barrier panel.

4. The barrier of claim 3, wherein the first barrier panel, the second barrier panel and the third barrier panel provide a linear barrier.

5. The barrier of claim 3, wherein first barrier panel is supported by the fixing structure and wherein the second barrier panel and the third barrier panel are supported by and extend and retract from the first barrier panel only.

6. The barrier of claim 2, wherein the second barrier panel or third barrier panel, or both, is releasably securable in at least an extended position.

7. The barrier as in claim 6, wherein the second barrier panel or third barrier panel, or both, is releasably securable in a fully retracted position, a fully extended position, and any one of an array of positions between the fully retracted position and the fully extended position.

8. The barrier of claim 1, wherein each wall attachment member comprises a plate configured to be fastened to the wall.

9. The barrier as in claim 1, wherein each of the infill panels is a mesh panel.

10. The barrier of claim 1, wherein each of the perimeter frames is fabricated of structural steel members.

11. The barrier of claim 1, wherein the barrier further comprises an attachment point for a hoist line, via which hoist line and attachment point the barrier can be lifted and moved.

12. The barrier of claim 1, wherein the barrier further comprises portions extensible from each of the first end and the second end of the first barrier panel.

13. The barrier of claim 1, wherein the U-shaped channels extend for a length defined between the first and second ends of the first barrier panel.

14. The barrier panel of claim 1, wherein the third barrier panel comprises a perimeter frame and an infill panel, the perimeter frame comprising a top frame member, a bottom frame member and opposing side frame members, and wherein a top edge and a bottom edge of the third barrier panel locate in the upper and lower U-shaped channels, respectively, of the first barrier panel.

15. The barrier of claim 14, wherein the U-shaped channels extend for a length defined between the first and second ends of the first barrier panel.

16. The barrier of claim 14, wherein first barrier panel is supported by the fixing structure and wherein the second barrier panel and the third barrier panel are supported by and extend and retract from the first barrier panel only.

17. The barrier of claim 1, wherein the upper U-shaped channel is fixed to the top frame member of the first barrier panel and the lower U-shaped channel is fixed to the bottom frame member of the first barrier panel.

* * * * *